US012616884B2

(12) United States Patent
San Román Gómez

(10) Patent No.: US 12,616,884 B2
(45) Date of Patent: May 5, 2026

(54) GOLF BACKPACK

(71) Applicant: Pedro Máximo San Román Gómez, Madrid (ES)

(72) Inventor: Pedro Máximo San Román Gómez, Madrid (ES)

( * ) Notice: Subject to any disclaimer, the term of this patent is extended or adjusted under 35 U.S.C. 154(b) by 0 days.

(21) Appl. No.: 18/854,194

(22) PCT Filed: Mar. 29, 2023

(86) PCT No.: PCT/EP2023/058080
§ 371 (c)(1),
(2) Date: Oct. 4, 2024

(87) PCT Pub. No.: WO2023/202850
PCT Pub. Date: Oct. 26, 2023

(65) Prior Publication Data

US 2025/0249321 A1 Aug. 7, 2025

(30) Foreign Application Priority Data

Apr. 20, 2022 (ES) ..... 202230358

(51) Int. Cl.
*A63B 55/40* (2015.01)
*A63B 55/00* (2015.01)
*A63B 55/57* (2015.01)

(52) U.S. Cl.
CPC ..... *A63B 55/40* (2015.10); *A63B 55/408* (2015.10); *A63B 55/57* (2015.10); *A63B 2225/62* (2013.01); *A63B 2225/64* (2013.01)

(58) Field of Classification Search
CPC ..... A63B 55/40; A63B 55/408; A63B 55/57; A63B 2003/007; A45B 11/02
(Continued)

(56) References Cited

U.S. PATENT DOCUMENTS 2,422,315 A * 6/1947 Robinson ..... A45F 5/1566 206/315.7
3,903,944 A * 9/1975 Montgomery ..... A45C 3/00 224/438

(Continued)

FOREIGN PATENT DOCUMENTS

FR 2899491 A1 10/2007

OTHER PUBLICATIONS

"PCT" International Search Report, mailed Aug. 10, 2023, for the Corresponding "PCT" International Application No. PCT/EP2023/058080, 5 pages.

(Continued)

*Primary Examiner* — Ernesto A Grano
(74) *Attorney, Agent, or Firm* — LUCAS & MERCANTI, LLP

(57) ABSTRACT

A golf backpack, having a main body with a front side and a back side substantially opposite each other, and which is attachable to the shoulders of a user by a pair of straps on the back side, and an internal structure arranged inside the main body. The backpack has a support structure arranged on outside the main body, on the front side and fixed to the internal structure, having this support structure fastenings for the balanced positioning of golf sticks arranged in use of the backpack in a plane parallel to the back side of the main body and symmetrically with respect to a vertical Z axis.

20 Claims, 14 Drawing Sheets

(58) Field of Classification Search
USPC ..... 206/315.3
See application file for complete search history.

(56) References Cited

U.S. PATENT DOCUMENTS 4,369,903 A * 1/1983 Wilkes ..... A45F 3/08 224/635
4,655,346 A * 4/1987 Reinholz ..... A63B 55/40 206/315.6
4,676,418 A * 6/1987 Lowe ..... A45F 3/047 224/262
5,184,763 A * 2/1993 Blaisdell ..... A45F 3/04 224/583
5,415,284 A * 5/1995 King ..... A63B 55/60 280/DIG. 6
5,419,473 A * 5/1995 Lamar ..... A63B 55/00 206/315.6
5,954,250 A * 9/1999 Hall ..... A62B 25/00 224/629
6,149,041 A * 11/2000 Perino ..... A63B 55/00 224/582
6,182,874 B1 * 2/2001 Feldman, Jr. ..... A45C 13/30 206/315.3
6,460,747 B1 * 10/2002 Tuerschmann ..... A63B 55/408 224/264
6,510,944 B2 * 1/2003 Chang ..... A63B 55/00 206/315.6
6,536,641 B1 * 3/2003 Sundara ..... A47C 1/14 224/641
7,232,049 B2 * 6/2007 Meyer ..... A45F 3/08 224/628
7,337,935 B1 3/2008 Glanville
7,350,683 B2 * 4/2008 Meyer ..... A63B 55/408 224/628
8,066,119 B2 * 11/2011 Doman ..... A63B 55/408 206/315.6
8,708,206 B2 * 4/2014 Onessimo ..... A45C 3/00 224/644
D784,684 S * 4/2017 Mancuso ..... D3/216
11,452,360 B1 * 9/2022 Cedeno, Sr. ..... A45C 13/103
12,329,269 B2 * 6/2025 Gustafsson ..... A45F 3/04
2008/0169210 A1 * 7/2008 Heidenreich ..... A63B 55/408 211/70.2
2008/0185411 A1 * 8/2008 Rome ..... A45F 3/04 224/633
2009/0145787 A1 * 6/2009 Grander ..... A63B 55/50 206/315.6
2010/0176012 A1 * 7/2010 Carter ..... A45F 5/1566 206/315.3
2011/0290844 A1 * 12/2011 Hoffman ..... A45C 13/10 224/269
2015/0108189 A1 * 4/2015 Plante ..... A45F 3/04 224/259
2016/0278507 A1 * 9/2016 Ponx ..... A45C 13/20
2016/0302555 A1 * 10/2016 Mancuso ..... A45F 3/04
2017/0055698 A1 * 3/2017 Jose ..... F16M 13/022
2019/0137160 A1 * 5/2019 Larsen ..... F25D 3/08
2021/0145137 A1 * 5/2021 Williams ..... A45F 5/1566
2023/0149783 A1 * 5/2023 Huguelet ..... A45F 3/04 224/577
2024/0023698 A1 * 1/2024 Fishwick ..... A45F 3/14
2024/0049852 A1 * 2/2024 Verma ..... A45C 5/14
2024/0074566 A1 * 3/2024 Hayward ..... A45F 3/04

OTHER PUBLICATIONS

"PCT" Written Opinion of the International Searching Authority, mailed Aug. 10, 2023, for the Corresponding "PCT" International Application No. PCT/EP2023/058080, 7 pages.

* cited by examiner

GOLF BACKPACK

CROSS-REFERENCE TO RELATED APPLICATION

This application is a 371 of PCT/EP2023/058080, filed Mar. 29, 2023, which claims the priority from Spanish Patent Application No. P202230358, filed Apr. 20, 2022, and the contents of each of which are incorporated herein by reference.

FIELD OF THE INVENTION

The present invention belongs to the technical field of equipment for sports practice, specifically to bags for transporting sports equipment, and more specifically to bags and backpacks for transport of all the equipment necessary for the golf practice, mainly golf sticks, to the golf course, likewise throughout the entire length of the golf course during practice. The present invention relates to a golf backpack having a support structure for the placement and balanced distribution of golf sticks.

BACKGROUND OF THE INVENTION

Golf has six centuries of history and from its beginnings to the present day the concept and use of bags carry the sticks has evolved significantly. In its beginnings, the sticks were tied by golf players with a rope for transporting them, but it was not until the end of the 19th century when the appearance of a concept similar to the bag we know today was dated, being manufactured in leather and canvas, materials that eventually gave way to nylon and plastic.

From the 20th century onwards, the type of golf game required a large number of different golf sticks to be able to make the necessary strokes, and additional space was needed for golf balls, gloves, manuals, etc. This meant that the bags became increasingly larger, which affected their portability and a poor maneuverability when the user carried it.

Conventional golf bags have long been in the shape of a tube or cylinder, and put the golf sticks together along the same. The bag usually has a handle, a strap for a shoulder or double strap for both shoulders, so that it can be carried, supporting these all the weight of the bag and, what is worse, in a decompensated way. This causes the user discomfort, fatigue, sluggishness and, more seriously, back injuries.

Conventional bags are manufactured in different materials and qualities, based on the use and pleasure of each golf player, the most commonly used being canvas, rubber, leather or fur and other fabrics.

With the use of electric carts or buggies, the user no longer had to carry the bag, so they became large, and also included a bottom to adapt it to the cart. Alternatively, a large number of hand carts were developed, whereby the user makes the course on foot, but carries the golf bag in the hand cart, which avoids carrying it on shoulders.

However, these electric and hand carts are not practical for all golf players. The advantage of using a comfortable golf backpack-bag is that the user travels the shortest way to his ball, being able to skip the cordoned off areas (any area that protects areas of approach to greens so that the carts do not damage these delicate grounds and other areas) getting not delay the time of play and thus combating the so-called and dreaded slow game. When driving a buggy or using an electric cart during play on a golf course, you are obliged to respect the markers and cordoned off areas in certain zones and not cross them, in fact, in most of the golf courses only buggies can be driven on the paths. This implies that the user cannot move directly to his ball to hit it, but by not being able to get out the paths with the buggy, he must walk from where he leaves the buggy to his ball, hit it and return to buggy, which causes and increases slow game.

Further, children cannot use electric carts because they are designed for adult golf players due to their weight, power and difficult maneuverability. They cannot use buggies either, for which you have to be of legal age, at least in Spain, and because of their dangerousness, so they can only use the alternative of hand carts. However, at present, hand carts are exceptionally large, with a support point not designed for height and body mass of children, causing them to drop the sticks from the bag while playing and even the cart bag itself, which increases slow game.

In addition to the above, there is currently a golf modality, called "speed golf", or "running golf", in which the golf course is completed by running, with the objective of finishing the course in the shortest time possible. In this modality, no electric or hand carts are used, so users must carry the golf bag with the sticks on their shoulder or back in order to go directly and in a straight line (without delay and without slowing down the game) to the ball and execute the next stroke.

Current golf bags, as mentioned above, are shaped like a tube or cylinder, not necessarily round or circular in cross-section, which put the sticks together along the same. The bag usually has a handle, a strap for a shoulder or double strap for both shoulders, so that it can be carried, supporting these all the weight of the bag and, what is worse, in an unbalanced way.

These current bags are overweight due to the number of sticks they carry, and the user also bears the weight in a decompensated way due to the placement of such sticks, since the golf sticks concentrate most of the weight on the head, being the metal part of the same. This causes the distribution of weight along the length of the bag to become decompensated, resulting in a constant maladjustment of the weights that cause imbalance when walking, causing the user to force the posture, in addition to the possibility that the sticks may fall to the ground, with the consequent discomfort caused, and even misplacement of the same. All of the above causes the golf player not to stay focused on the game, resulting in a state of discomfort and pressure, since they cannot maintain a reasonable pace of play, because they are forced to keep their attention on the transport of the sticks and the possible misplacement of them.

Likewise, carrying the traditional bag of sticks on their back with the sticks and other accessories means carrying a decompensated and unbalanced weight load on their body. This causes discomfort and injuries, mainly in the lower back, shoulders, knees, ankles, etc., when walking for several hours.

It is therefore desirable to have a bag for transporting the golf sticks in a comfortable and balanced way, and with the weights compensated, thus avoiding the disadvantages of the existing systems in the state of the art.

DESCRIPTION OF THE INVENTION

The present invention solves the problems existing in the state of the art by means of a golf backpack, for storing and transporting the equipment necessary for golf practice, mainly golf sticks, to the golf course, and likewise throughout the entire length of the golf course during practice.

The golf backpack has a main body having a front side and a back side substantially opposite each other, and which is attachable to shoulders of a user by means of a pair of straps arranged on the back side. The backpack has an internal structure arranged inside the main body, as a frame or internal skeleton. Further, the backpack has a support structure arranged on the outside of the main body, on its front side, and attached to the internal structure inside the backpack. This support structure has fastenings for the balanced placement of golf sticks, such that when the backpack is in use, i.e., arranged on the user back, the golf sticks are arranged in a plane parallel to the back side of the main body and symmetrically with respect to a vertical Z-axis.

Preferably, the support structure will be configured such that the fastenings are movable to enable different placements of the golf sticks according to particular needs or preferences of the user, or to adapt to certain circumstances of the game or course.

In accordance with different particular embodiments of the invention, the fastenings may consist of clipping means arranged on the support structure, on which the golf sticks are hooked.

Alternatively, the fastenings may be magnetic means, such as neodymium magnets, to which the metal parts of the various golf sticks are attached by magnetic attraction.

Further, the support structure can be hollow and feature holes in its outer surface for the passage of golf sticks. In this case, in addition to further fastenings that may exist in the support structure for the hooking or fixing of the golf sticks, at least some of these holes on the outer surface of the support structure will act as fastenings, matching with these, for example, so that the golf sticks are inserted through the holes and the heads are supported on these holes, thus holding the golf sticks in place.

According to different embodiments of the support structure, it can have a section in a plane parallel to the back side of the main body, either regular polygonal, or circular, or oval, with symmetry axis to the vertical Z axis. Preferably this section can be triangular, square, circular or oval.

In accordance with an embodiment alternative to the above, the support structure can be formed by two tubular boxes, which could be cylindrical or prismatic, open at their ends, and joined together in the shape of a cross by means of a pivot. This pivot allows the rotation of the tubular boxes around an axis perpendicular to the back side of the main body, allowing the variation of the angles of the arms of the cross, i.e. the variation of the angles that the boxes present to each other.

These different embodiments of the support structure allow to arrange the golf sticks in a cross or "X" shape, or even in almost horizontal lines with the aim of distributing the weight of the whole set of sticks in the most balanced way possible, placing them by length and weight in the most balanced way possible on the golf player back, so as not to put more overweight on one hemisphere of the back than on the other, avoiding the golf player to play with an uncomfortable posture, possibly damaging the back, shoulders, ankles, etc.

Preferably, the support structure is fixed to the internal structure by means of a ball joint. This allows the support structure to rotate relative to the three XYZ axes.

According to different particular embodiments of the invention, the backpack has a lumbar belt attachable to the lumbar area and waist of the user, and adjustable in length. Preferably, this lumbar belt can be detachable from the backpack. Further, preferably the lumbar belt may have inflation means including valve and nozzle, for inflating the belt and providing an ergonomic and padded element to the user, which absorbs the vibrations of movement. This lumbar belt adjusts to the waist and lumbar area of the user, so that the weight of the backpack is distributed between the waist and shoulders, relieving the latter of carrying all the weight. Thus, typical back injuries typical are reduced or alleviated of golfers caused by carrying the conventional bag with all the weight on the shoulders in an unbalanced way.

Additionally, the backpack may have a chest belt that can be attached to the user chest area and adjustable in length.

Likewise, in the backpack object of the present invention, at least part of the areas in contact with the user may be padded, may be made of mesh fabric or grid to provide ventilation, and also in various areas in contact with the user may have heating means, such as battery-powered heating elements. Likewise, as little material as possible will be used to lighten the weight of the backpack.

In accordance with a preferred embodiment of the invention, the backpack may have an umbrella holder arranged outside the main body, which preferably will be disposed on the front side and fixed to the internal structure. With this configuration, the umbrella holder allows the umbrella to be carried both closed and open for use, leaving the user hands free to not only move around, but also to use the golf sticks while covered with the umbrella.

In accordance with different particular embodiments of the invention, the backpack has a removable tripod arranged inside the main body, which preferably has a plurality of legs, which slide along rails arranged inside the main body, until its unfolded at the base of the backpack, which will allow the support of the backpack in an upright position, with some inclination, without the need to remove the golf sticks from the support structure. This allows the golf player to conveniently select the golf stick to be used. The tripod folds up again when the bag is lifted off the ground. Alternatively to the removable legs, the tripod may feature one or more rods that stick into the ground when the backpack is put down.

The present golf backpack can preferably be made from recycled and lightweight materials (e.g., certain plastics and/or glass), making it a more practical, sustainable, and extremely lightweight backpack, intended primarily for golfers who like to walk. It is used to carry the play sticks, as well as balls, tees, gloves, towel, distance gages, and other practical gadgets for playing golf, and even a defibrillator, and to carry them while playing golf on the course, on the driving range, and even when traveling. All these elements can be stored in different pockets and compartments arranged along the entire external surface of the main body of the backpack, and its straps and belts. In this way, all the equipment remains put together and possible losses are avoided.

By means of the support structure, the golf backpack places the set of golf sticks on an element that serves as a platform, which distributes the weight in a balanced and equitable manner, relieving the shoulders from being the only protagonists when it comes to supporting the entire weight of the bag, avoiding or directly reducing negative effects on the golf player health, both mechanically and motorly, since the golf player who chooses to walk carries the golf backpack on his shoulder or shoulders for several hours. The backpack of the invention allows a more comfortable and healthy transport for the golf player back (whether during the game or not), avoiding, reducing and even alleviating the most common injuries such as shoulder, back and ankle injuries, which improves the physical tone avoiding exhaustion during the development of the game, and avoiding slow game, which is one of the main problems of modern golf worldwide for a long time, since it also causes damage to other players, organization, etc.

Carrying golf sticks in the shape of a cross or "X" when traveling by motorcycle or bicycle is much safer for the user. The reason is the balanced distribution and weight compensation of the backpack.

Further, when traveling or storing the backpack, for example, in a club room, closet, or trunk of a car, the support structure where the sticks are carried allows the movement of the fastenings, allowing the golf sticks to be aligned, coming out of their X-shaped position at different angles, which facilitates their transport and storage. The backpack without the sticks will also be easily foldable, taking up minimal space inside a travel bag or briefcase, noticeably light and completely discreet, thus preserving the contents of the same, and will be ideal for checking in as special luggage at airports, location in lockers in stick rooms, etc.

In the case of children it will allow them to keep their back healthy and will facilitate the transport of their equipment, given that as indicated above, currently, the hand carts available for rent are very large, with a support point not designed for the height and body mass of children, thus causing them to drop the sticks from the bag while playing, and even the bag itself. Therefore, the golf backpack of the present invention solves these problems, and furthermore decreases the slow game caused by these drops of golf sticks or the bag containing them.

Further, this golf backpack favors the game in its "speed golf" or "running golf" modality, since it allows golf players to carry the sticks in a comfortable and efficient way throughout the competition, and they will be able to run with the load compensated and balanced, ergonomically adjusted to their back and waist, and thus avoid the wobble produced by the golf sticks in conventional bags, by not being balanced and not completely fastened. This allows the course to be completed in the shortest possible time, allowing the golf player to run freely without worrying about weight sway or misplaced equipment, avoiding numerous stops to pick up and adjust the equipment. This backpack also allows the golf player to kick on the green without the need to take it off his back, thus gaining precious time to score in such competitions, as well as combating slow game even in the most conventional and traditional golf modalities.

BRIEF DESCRIPTION OF THE DRAWINGS

In the following, in order to facilitate the understanding of the invention, by way of illustration, but not limitation, an embodiment of the invention will be described with reference to a plurality of figures.

Figure 1:
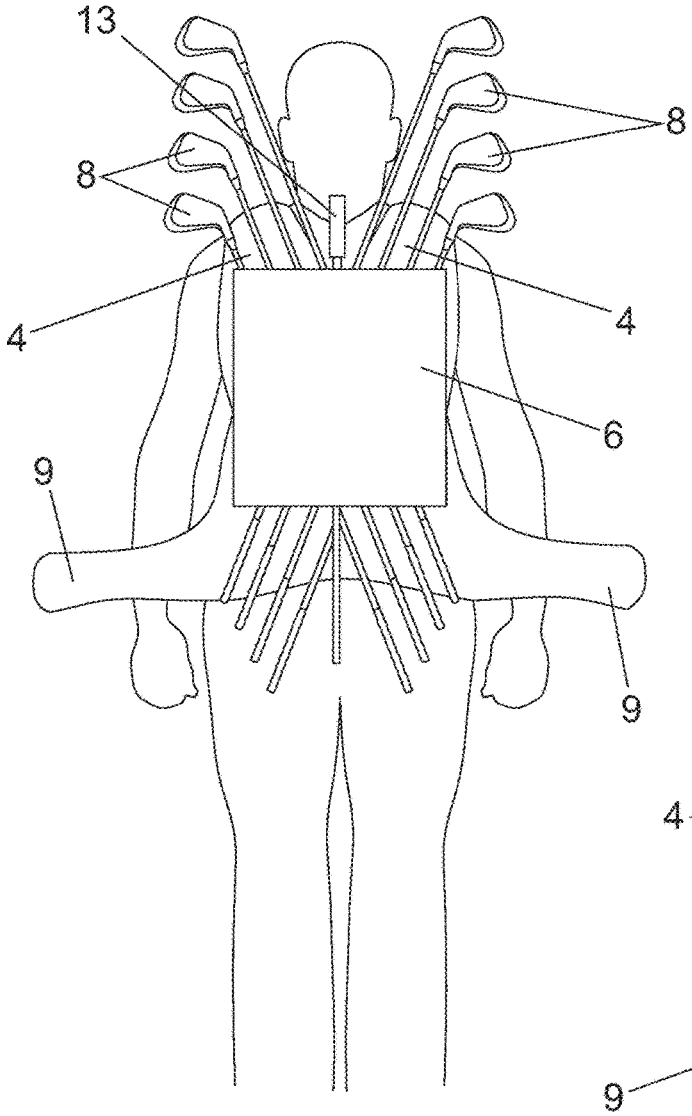
FIG. 1 shows a rear view of an embodiment of a golf backpack object of the present invention disposed on the back of a user.
Figure 2:
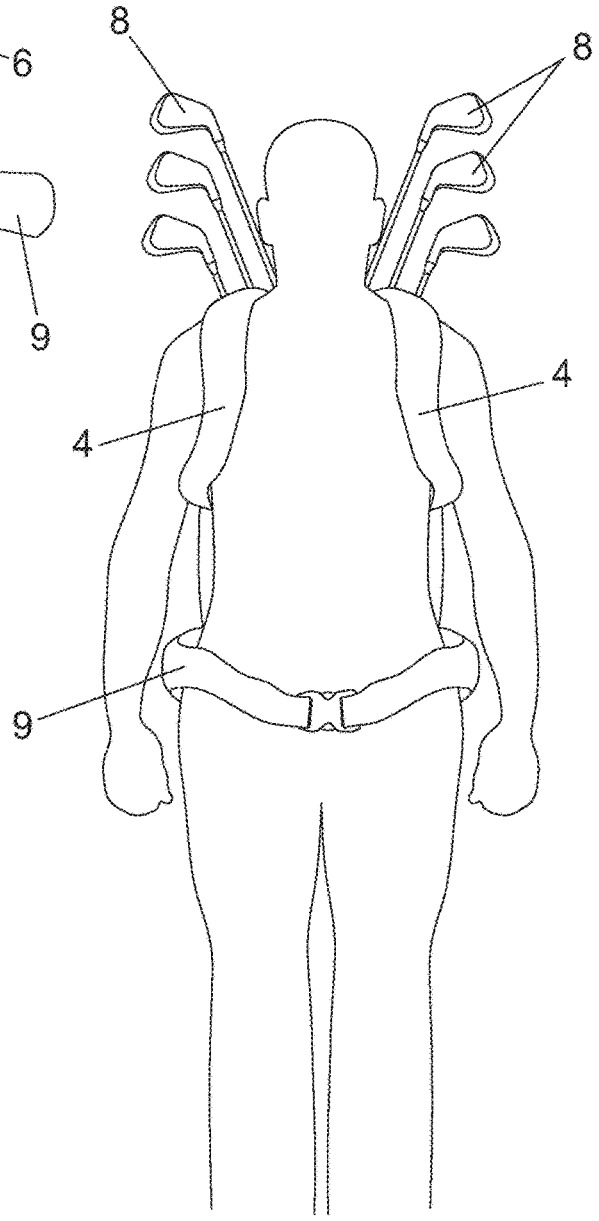
FIG. 2 is a forward front view of the backpack on the back of the user of FIG. 1.

In these figures reference is made to a set of elements which are:

1. main body
2. front side of the main body
3. back side of the main body
4. straps
5. internal structure
6. golf stick support structure
7. fastenings
8. golf sticks
9. lumbar belt
10. inflation means of the lumbar belt
11. chest belt
12. tripod
13. umbrella holder
14. tubular boxes of the support structure
15. joint pivot of the tubular boxes
16. ball joint

DETAILED DESCRIPTION OF THE INVENTION

The object of the present invention is a golf backpack, for storing and transporting the equipment necessary for the practice of golf, mainly golf sticks, to the golf course, and also along the entire length of the course during the sports practice.

As can be seen in the figures, the golf backpack has a main body 1 having a front side 2 and a back side 3, both sides 2 and 3 being substantially opposite. The backpack is attachable to the shoulders of a user by means of a pair of straps 4 arranged on the back side 3 of the main body 1. The backpack further features an internal structure 5 inside the main body 1, as a frame or internal skeleton. Further, the backpack has a support structure 6 for the attachment of golf sticks 8. The support structure 6 is arranged on outside the main body 1, on its front side 2, and fixed to the internal structure 5 inside the backpack. This support structure 6 has fastenings 7 for the balanced positioning of the golf sticks 8, which are positioned in such a way that when the backpack is in use, i.e., arranged on the user back, the golf sticks 8 are arranged in a plane parallel to the back side 3 of the main body 1 and symmetrically positioned with respect to a vertical axis Z, as can be seen in the different embodiments of the figures.

Preferably, the support structure 6 will be configured such that the fastenings 7 are movable to enable different placements of the golf sticks 8 according to particular needs or preferences of the user, or to adapt to certain circumstances of the game or course.

Figure 4:
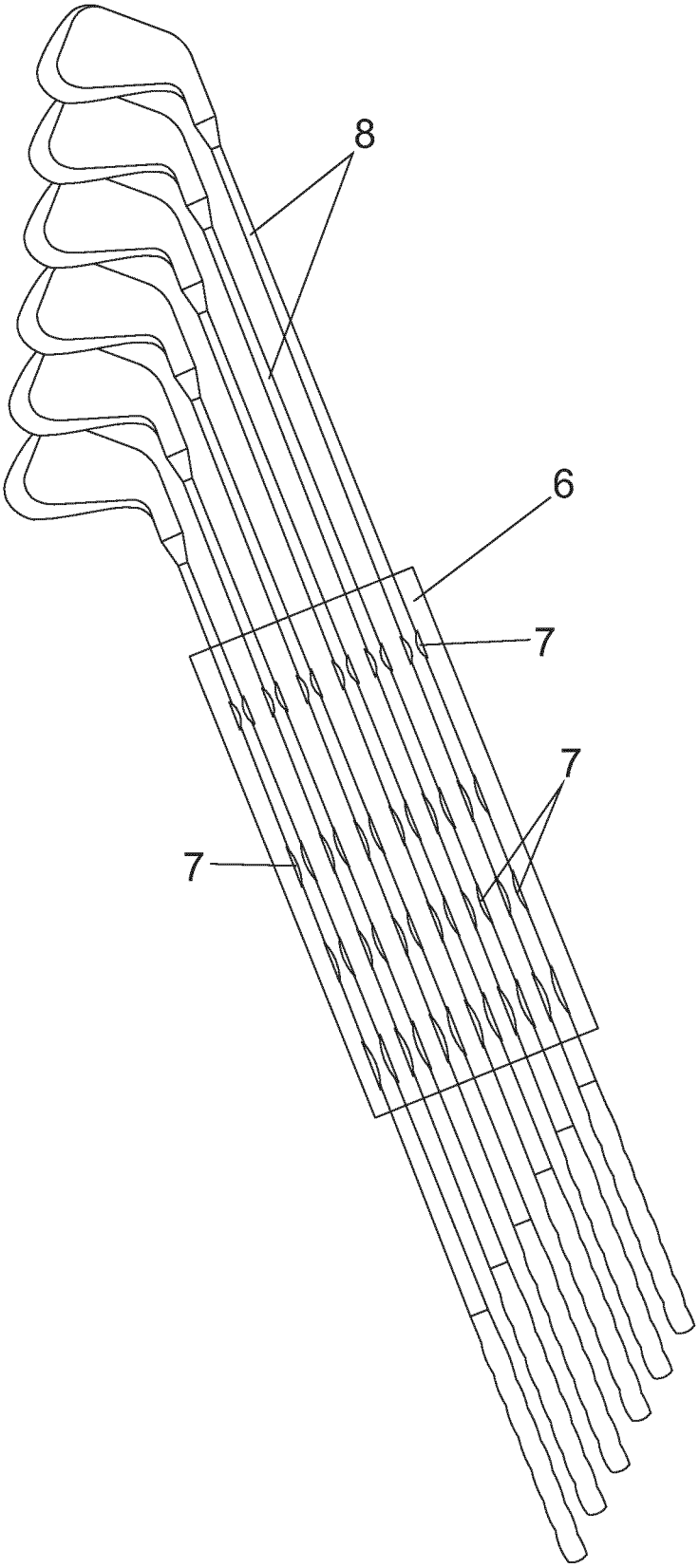
FIG. 4 shows an embodiment of fastenings of a support structure for the placement of golf sticks.
Figure 5:
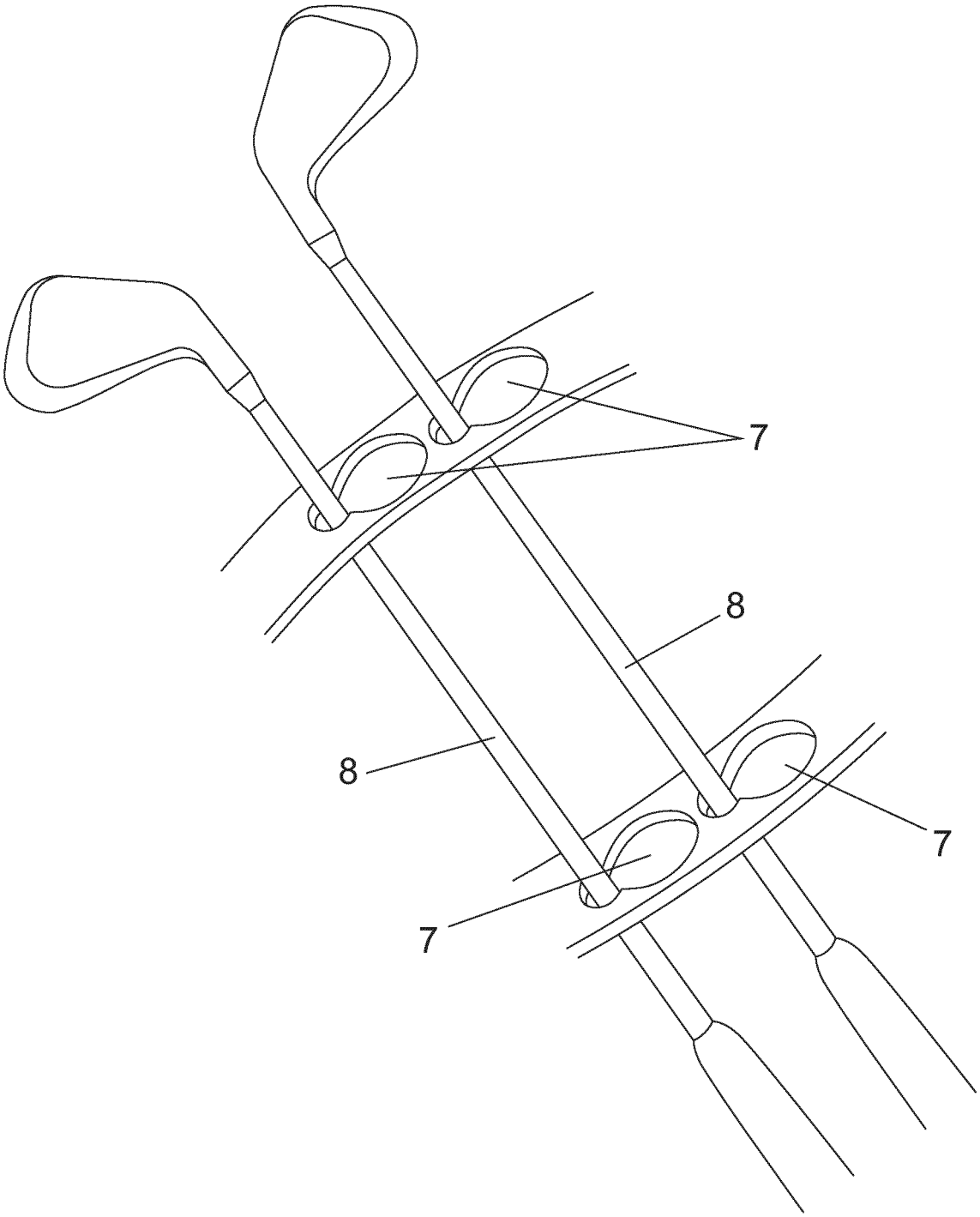
FIG. 5 shows an alternative embodiment of fastenings of a support structure for the placement of golf sticks.

In accordance with various particular embodiments of the invention, the fastenings 7 may consist of clipping means arranged on the support structure 6, on which the golf sticks 8 are hooked, as can be seen in FIG. 4 or 5.

Alternatively, the fastenings 7 could be magnetic means, such as neodymium magnets, to which the metal parts of the various golf sticks 8 are attached by magnetic attraction.

Further, the support structure 6 can be hollow and feature holes in its outer surface for the passage of golf sticks 8. In this case, in addition to further fastenings 7 that may exist in the support structure 6 for the hooking or fixing of the golf sticks 8, at least some of these holes on the outer surface of the support structure 6 will act as fastenings 7, matching with these, for example, so that the golf sticks 8 are inserted through the holes and the heads are supported on these holes, thus holding the golf sticks 8 in place.

According to different embodiments of the support structure 6, the latter may have a regular polygonal shape in a section of said support structure (6) along a plane parallel to the back side 3 of the main body 1. Preferably this polygonal shape can be triangular, square, circular or oval. FIGS. 8, 9, 10, 12 and 13 show some of these embodiments with the support structure 6 having a circular or polygonal cross-section.

In accordance with an embodiment alternative to above, which can be seen in FIGS. 6*a*, 6*b*, 7*a* and 7*b*, the support structure 6 can be formed by two tubular boxes, which could be cylindrical or prismatic, open at their ends, and joined together in the form of a cross by means of a pivot 15. This pivot 15 allows the rotation of the tubular boxes around an axis perpendicular to the back side 3 of the main body 1, allowing the variation of the angles of the arms of the cross, i.e., the variation of the angles presented by the boxes to each other, and therefore the angle presented by some golf sticks 8 over others.

Figure 14:
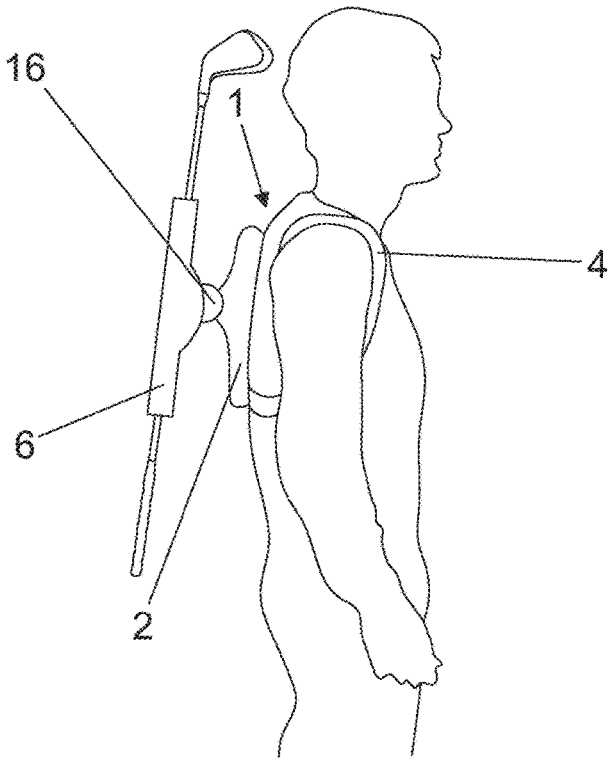
FIG. 14 shows the attachment of a support structure to the main body of a backpack by means of a ball joint.

Preferably, and as can be seen in FIG. 14, the support structure 6 will be fixed to the internal structure 5 by means of a ball joint 16. This allows the support structure 6 to rotate relative to the three XYZ axes.

Figure 6B:
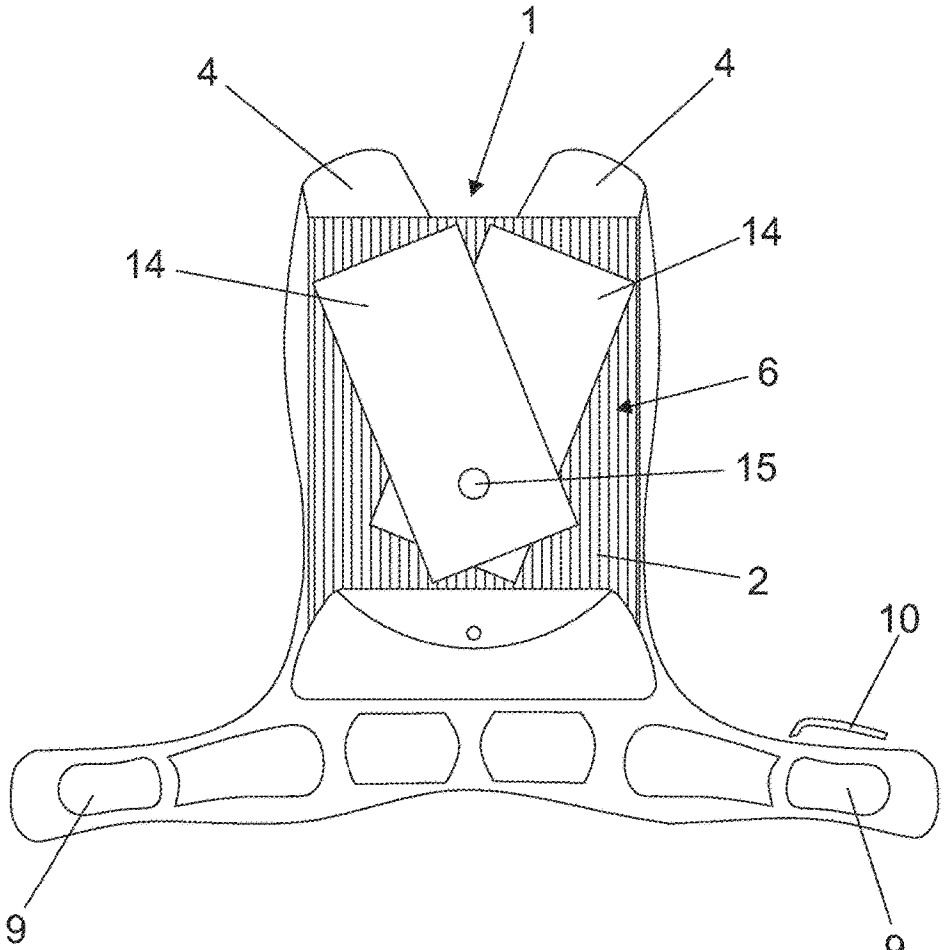
FIG. 6*b* shows the support structure of FIG. 6*a* arranged on the front side of the main body of a backpack.
Figure 6A:
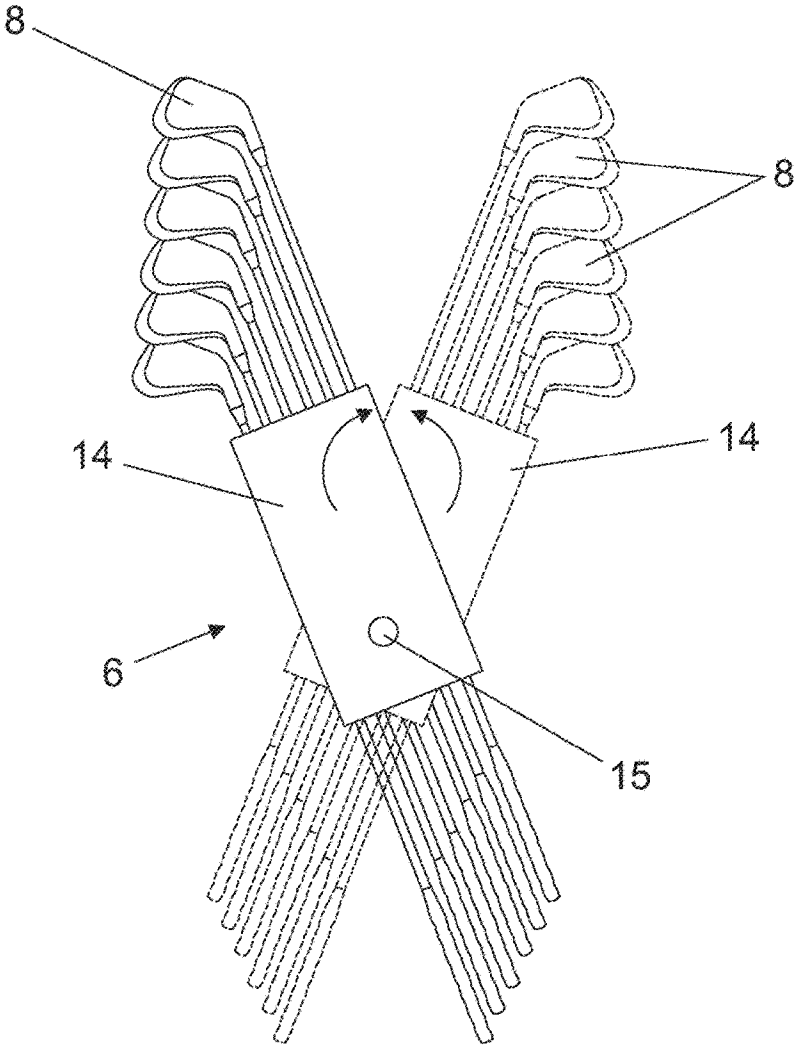
FIG. 6*a* shows schematically an embodiment of a support structure consisting of a pair of tubular boxes joined in cross shape by means of a pivot.
Figure 7B:
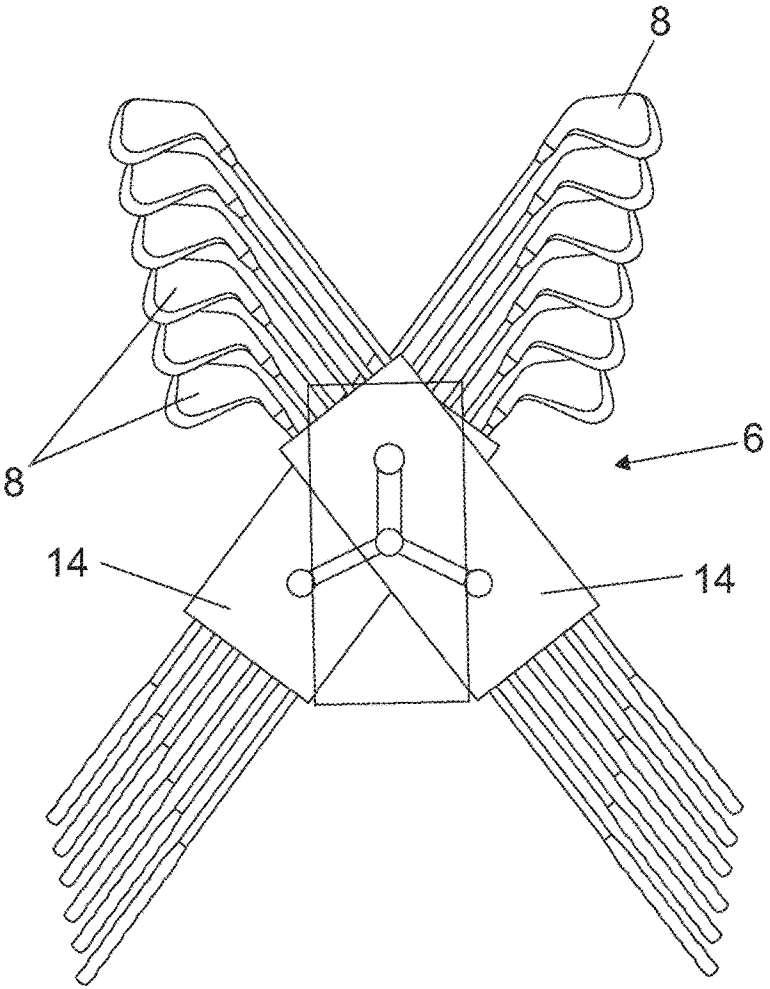
FIGS. 7*a* and 7*b* show an alternative embodiment of a support structure consisting of tubular boxes joined in cross shape by means of pivots which, in this case, limit the angular opening of the boxes.
Figure 7A:
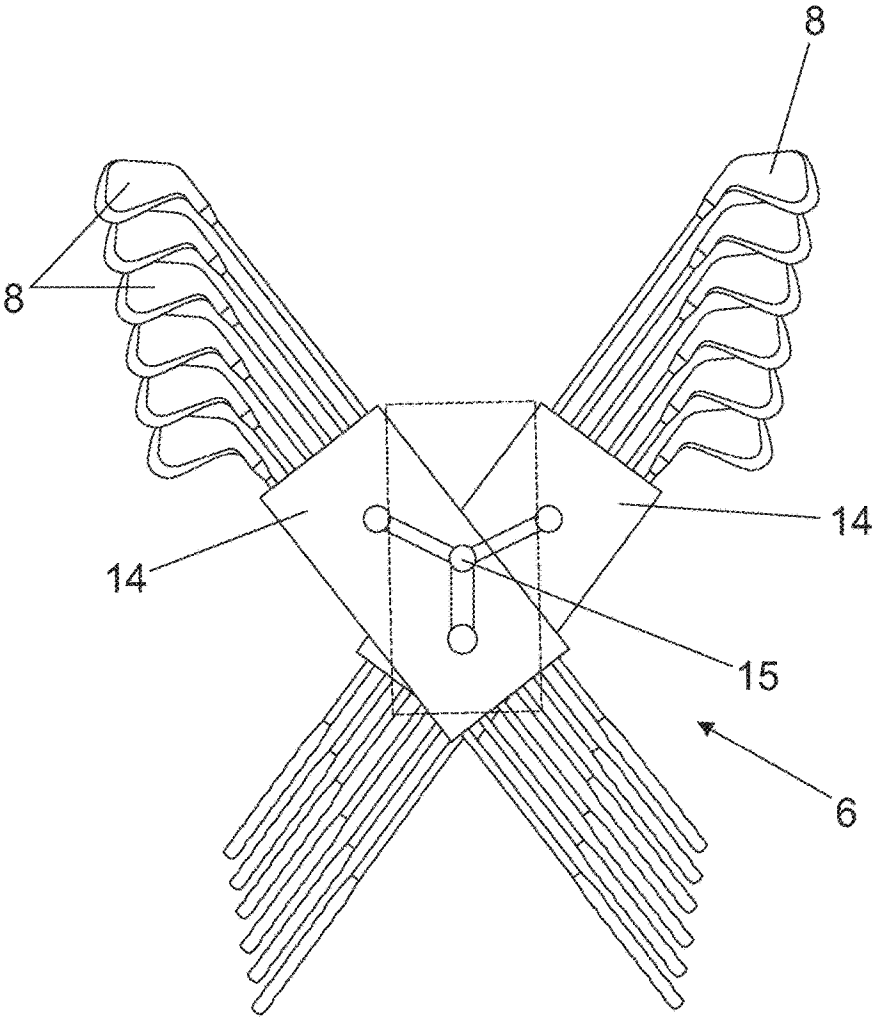
Figure 15:
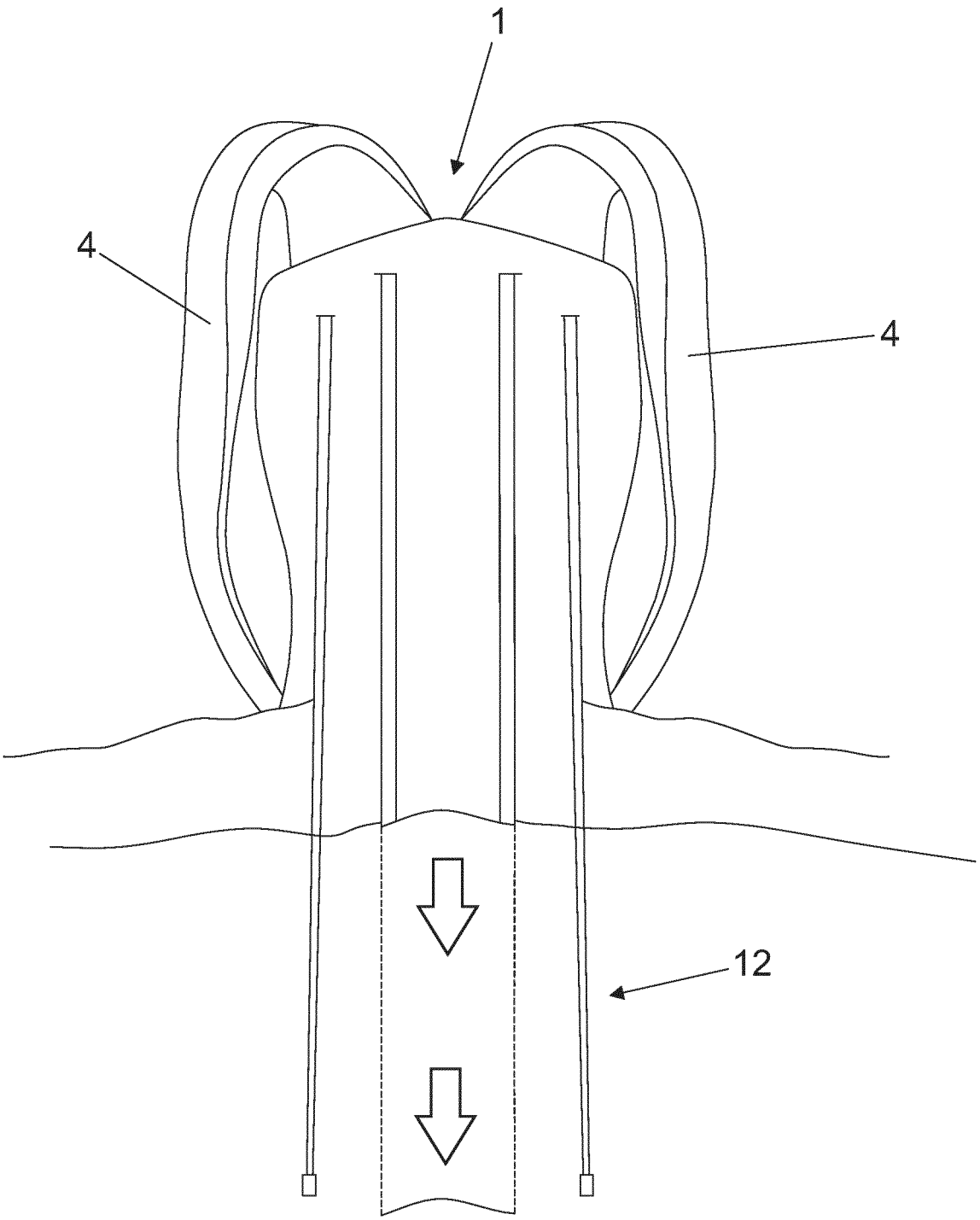
FIG. 15 shows a section of a golf backpack object of the present invention that includes a removable tripod, and the interior rails along which the tripod legs slide and are removed are shown.

According to different particular embodiments of the invention, the backpack can feature a lumbar belt 9 attachable to the lumbar area and waist of the user, and adjustable in length. Preferably, this lumbar belt 9 can be detachable from the backpack. Further, preferably the lumbar belt 9 may have inflation means 10 including valve and nozzle among others, for the inflation of the belt and thus provide an ergonomic element to the user. FIGS. 1, 2, 11*a*, 11*b*, and in more detail FIGS. 3, 6*b* and 15 show this lumbar belt 9 of the backpack, some of them including the inflation means 10.

Figure 3:
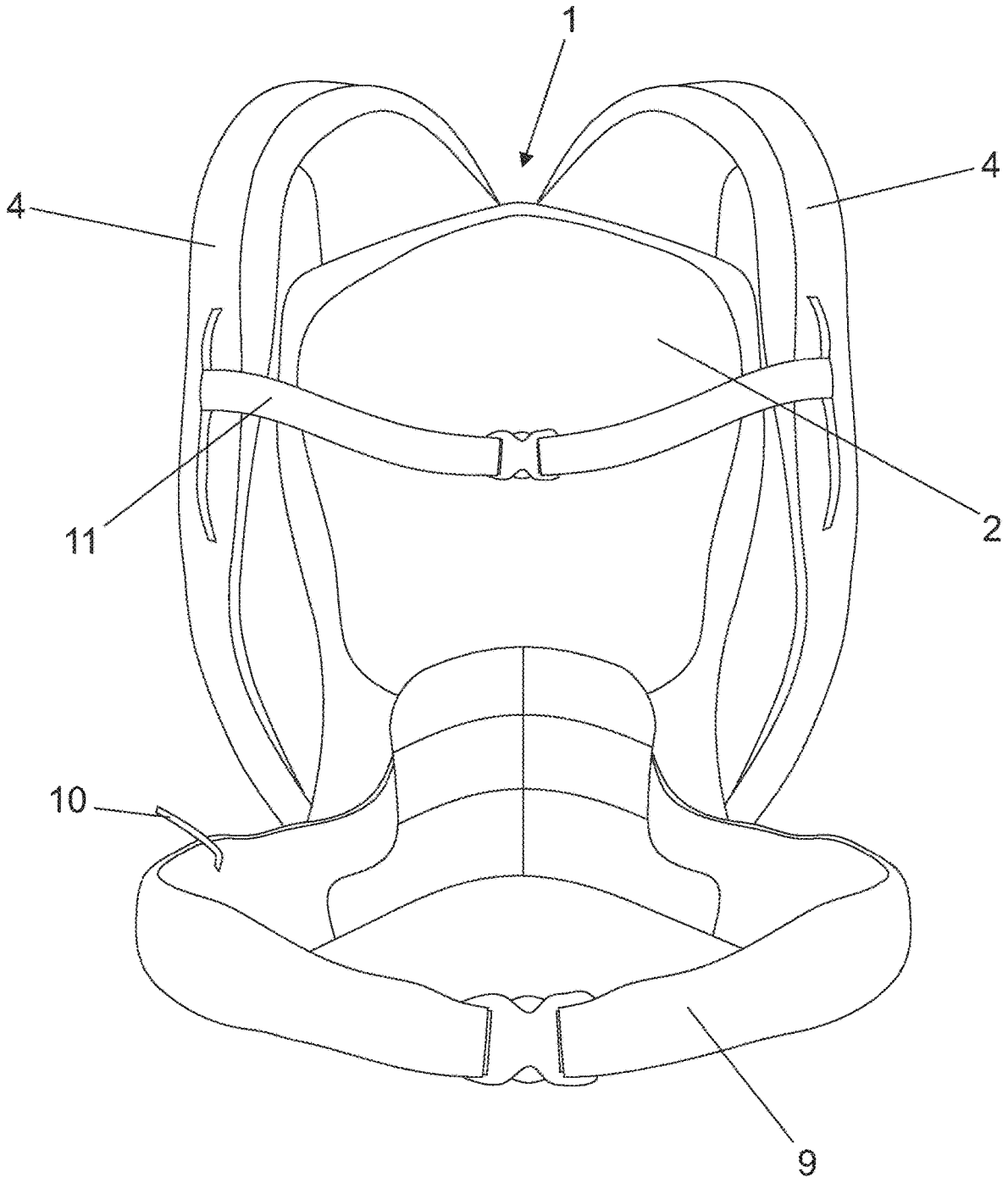
FIG. 3 is a perspective view of an embodiment of a golf backpack object of the present invention.

Additionally, as can be seen in FIG. 3, the backpack may feature a chest belt 11 attachable to the user chest area and adjustable in length, which favors load distribution and relieves weight from the user shoulders.

Likewise, in the backpack object of the present invention, at least part of the areas in contact with the user may be padded, may be made of mesh fabric or grid to provide ventilation, and also in various areas in contact with the user may have heating means, such as battery-powered heating elements, all oriented to provide increased comfort.

Figure 8:
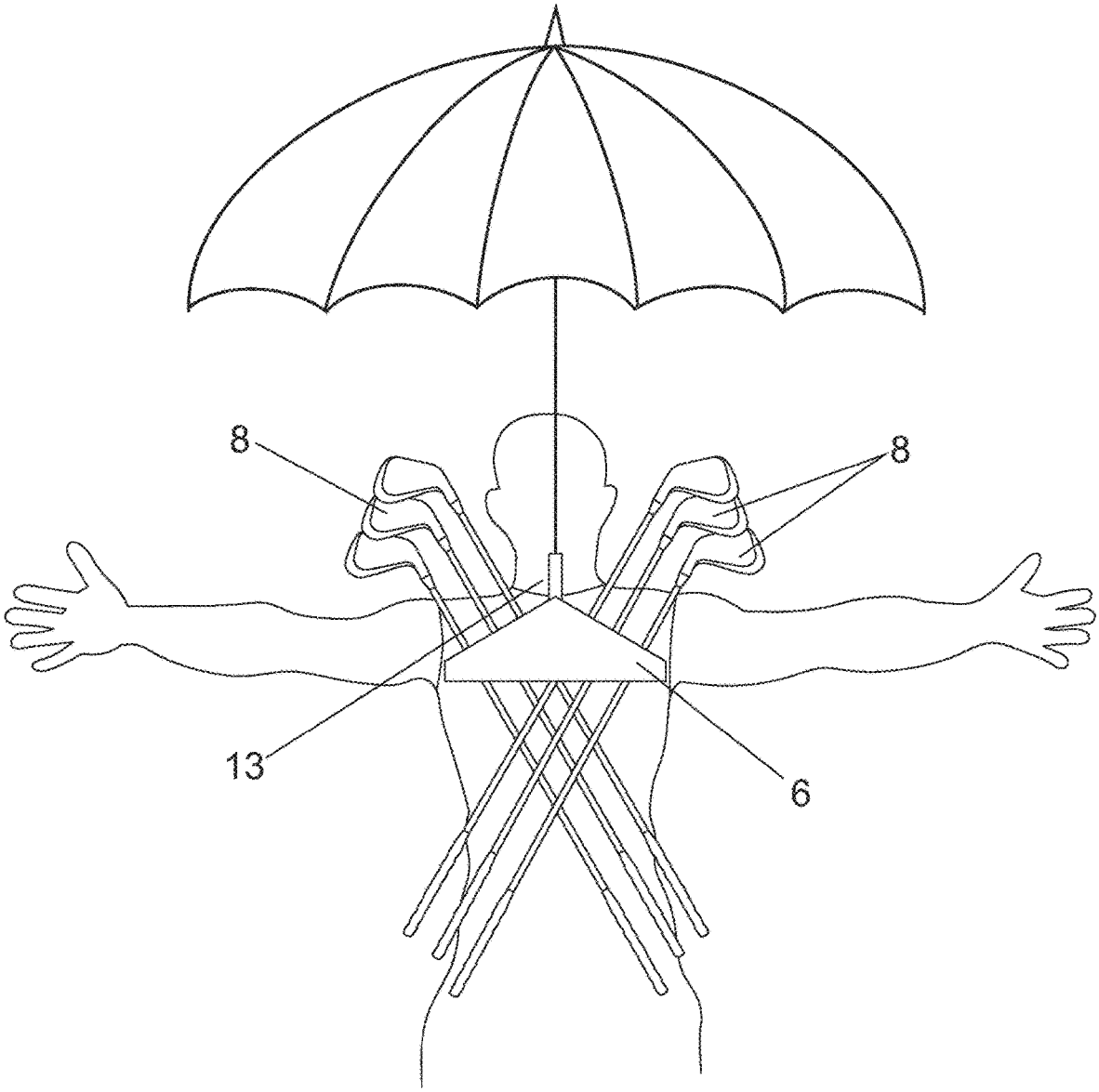
FIG. 8 shows schematically an alternative embodiment of a support structure, in this case of triangular cross-section, arranged in a backpack, which also features an umbrella holder.
Figure 9:
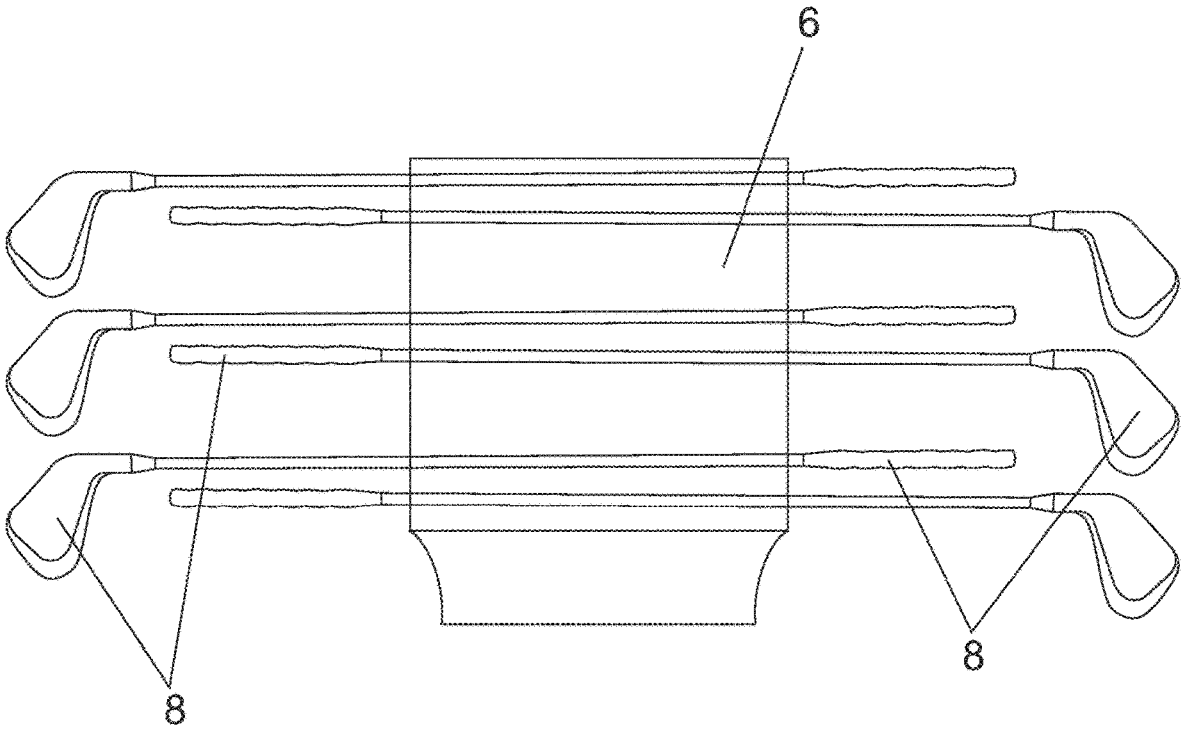
FIG. 9 schematically depicts another embodiment of a support structure, rectangular in cross-section, with the golf sticks arranged horizontally.
Figure 10:
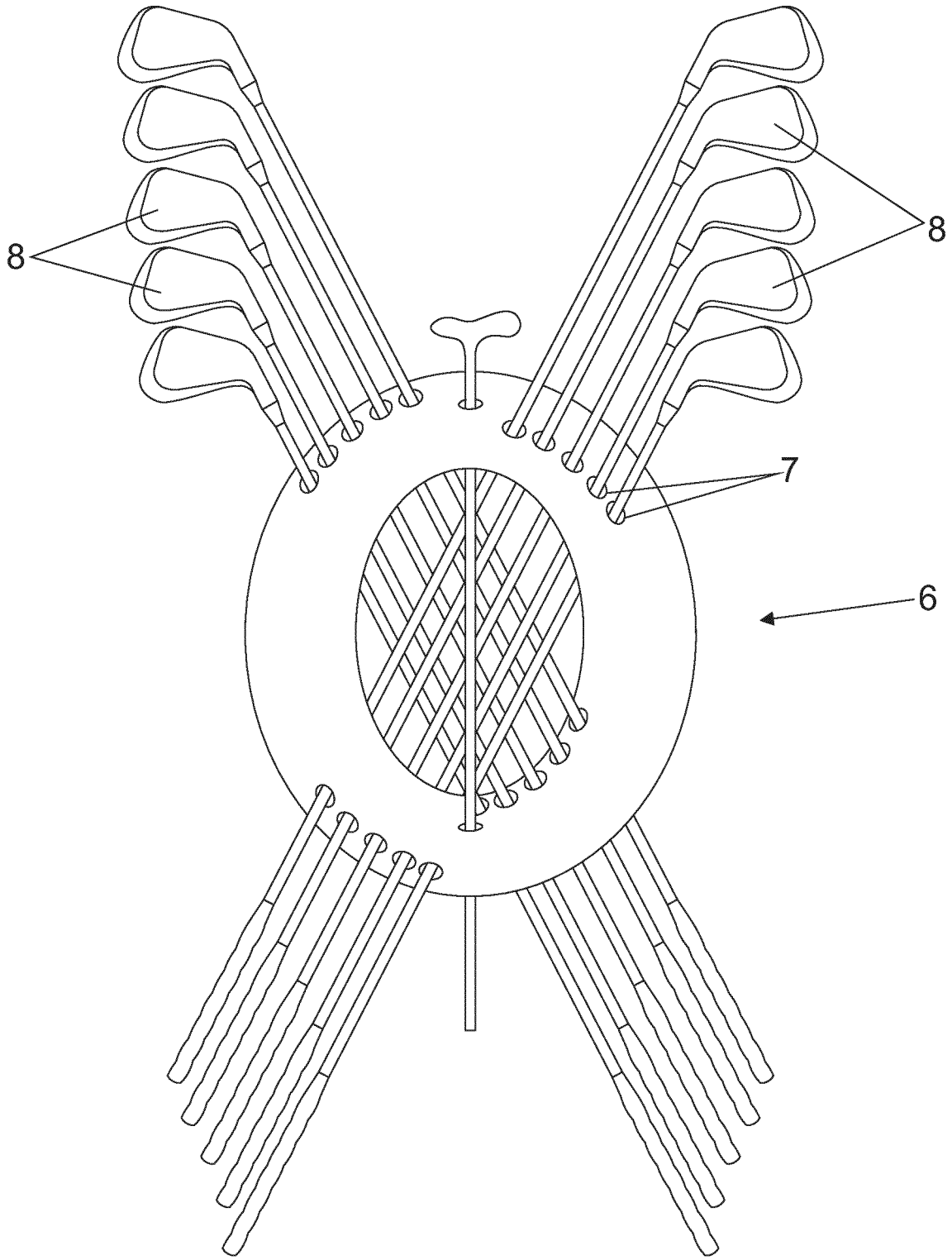
FIG. 10 shows schematically another embodiment of a support structure, in this case, annular, of circular cross-section.
Figure 11A:
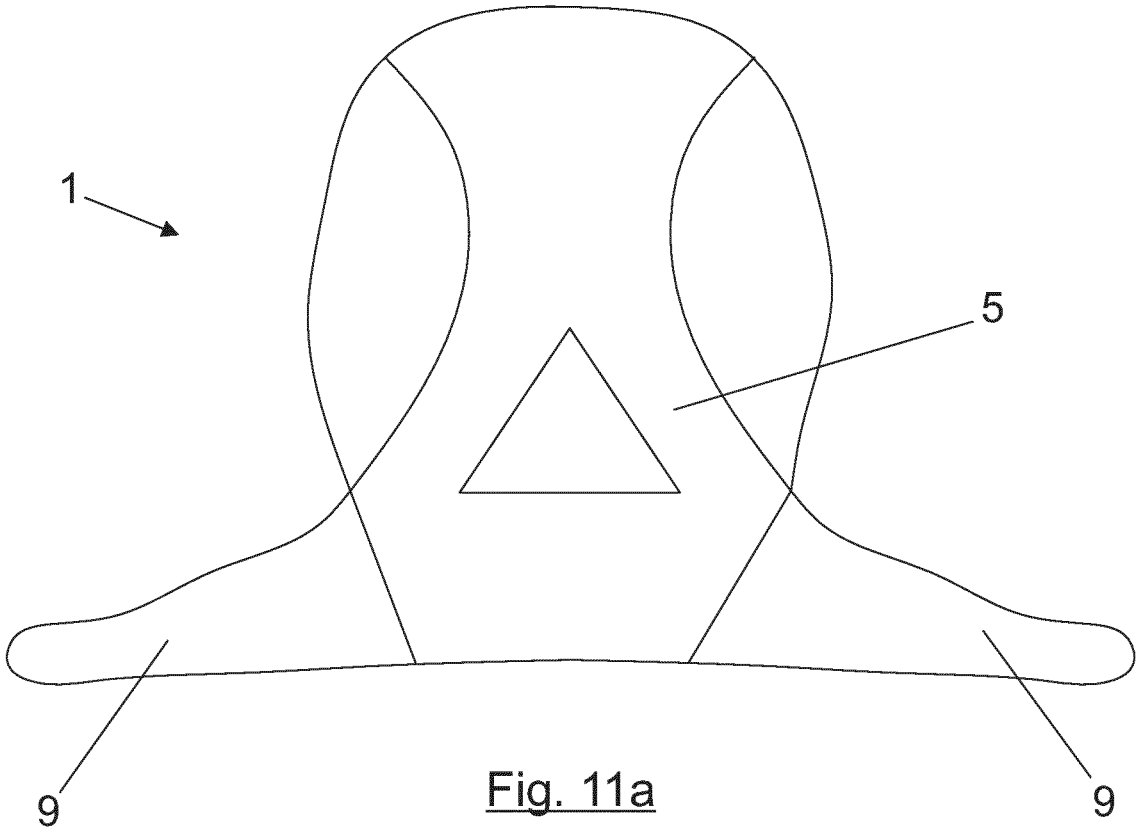
FIG. 11*a* shows a section of the main body of the backpack wherein an embodiment of an internal structure is shown, arranged inside the main body, for stiffening the backpack and fixing on it the support structure.
Figure 11B:
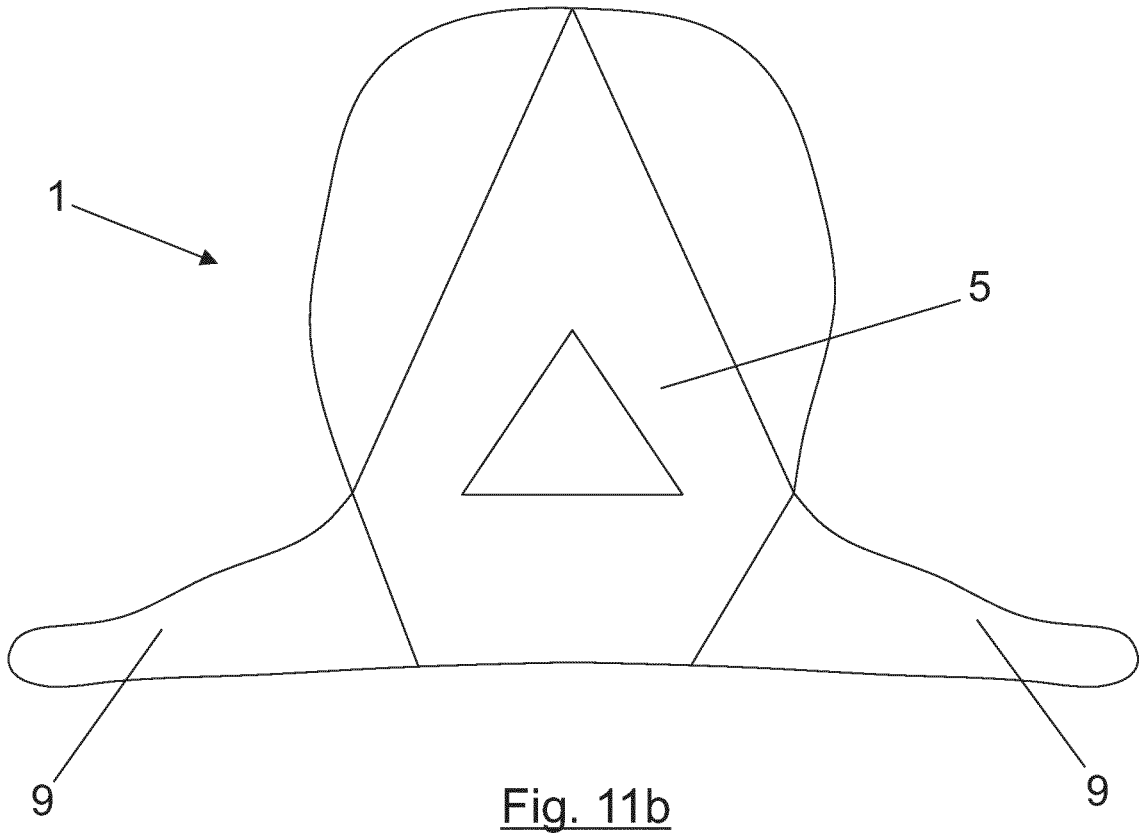
FIG. 11*b* shows an alternative embodiment of an internal structure in a section of the main body of the backpack.
Figure 12:
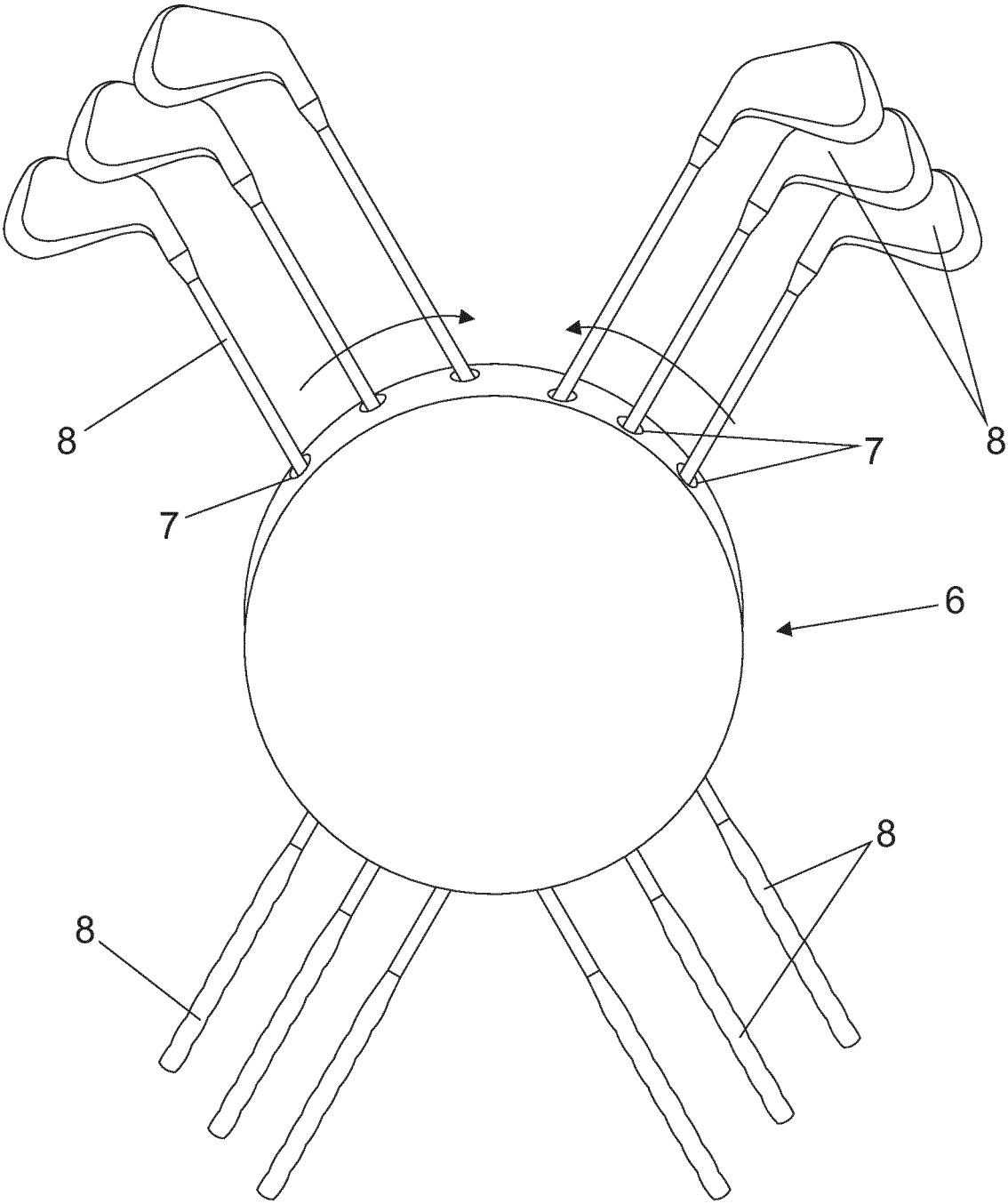
FIG. 12 schematically represents another alternative support structure of circular section formed by two external discs, one of them rotating with respect to the other to move the position of the fastenings.
Figure 13:
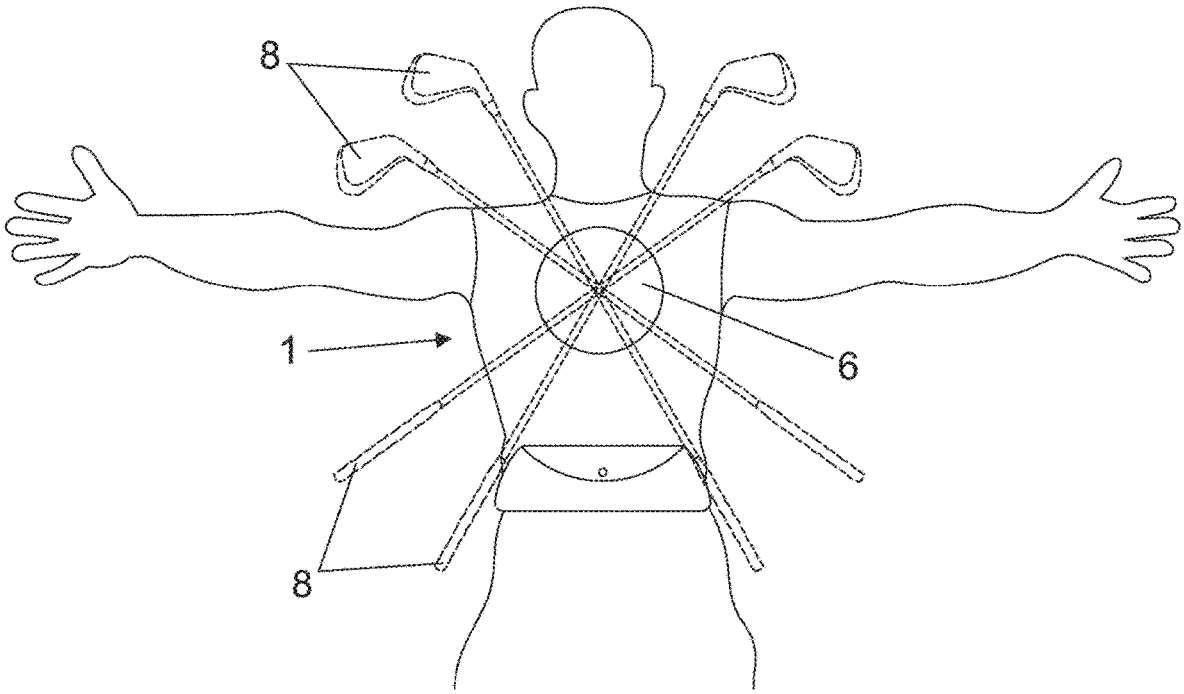
FIG. 13 schematically depicts a backpack on the back of a user with a circular section support structure, schematically showing different placements of the golf sticks.

In accordance with a preferred embodiment of the invention, the backpack may have an umbrella holder 13 arranged on outside the main body 1, which preferably will be arranged on its front side 2 and fixed to the internal structure 5, as can be seen in FIG. 8.

Figure 16:
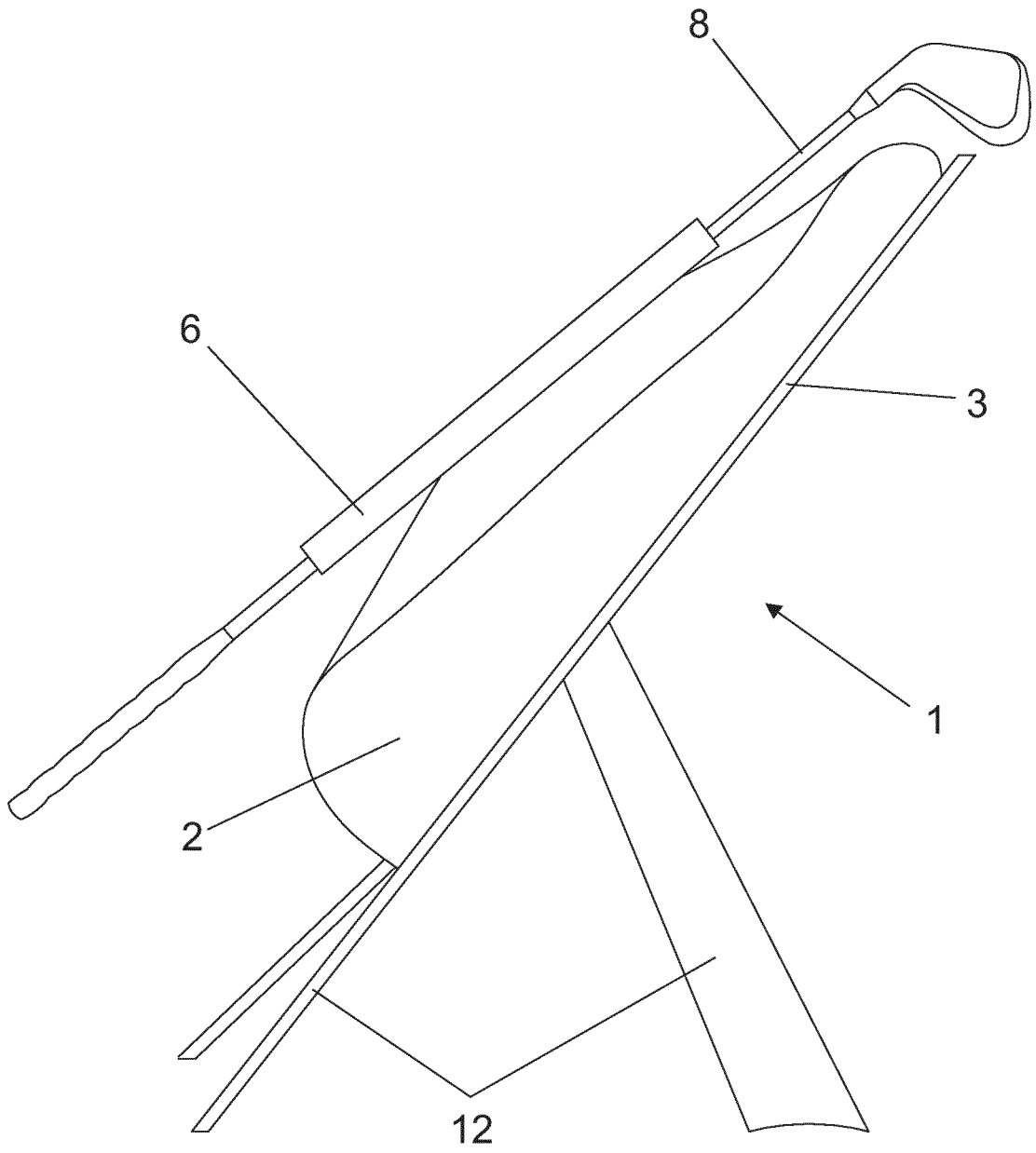
FIG. 16 shows schematically a backpack supported on a removable tripod.

As can be seen in FIGS. 15 and 16, in accordance with different particular embodiments of the invention, the backpack has a removable tripod 12 arranged inside the main body 1, which preferably has a plurality of legs, which slide along rails arranged inside the main body, until unfolded at the base of the backpack, which will allow the support of the backpack in an upright position, with some inclination, without the need to remove the golf sticks 8 from the support structure 6.

This removable tripod 12 can be operated by means of two side handles on the lower edges of the backpack, at about elbow level with the user, who can pull the handles or bases of the legs and slide them along the rails until they are removed. A set screw can be used to lock the legs in their extended position when the screw is tightened. Particularly, the tripod may have two rear legs that will extend sliding along two rails, and will be attached to a front leg in the shape of a "U", which slides along another rail.

The invention claimed is:

1. A golf backpack comprising a main body with a front side and a back side opposite each other, attachable to the shoulders of a user by means of a pair of straps arranged on the back side, and an internal structure arranged inside the main body, a support structure arranged on the outside of the main body, on the front side and fixed to the internal structure, said support structure comprising fastenings for a balanced positioning of golf sticks arranged in use of the backpack in a plane parallel to the back side of the main body and symmetrically with respect to a vertical Z axis, wherein the support structure comprises two tubular boxes open at their ends joined together in the shape of a cross by means of a pivot.

2. The golf backpack according to claim 1, wherein the fastenings are movable and configured to enable different placements of the golf sticks.

3. The golf backpack according to claim 1, wherein the fastenings comprise clipping means.

4. The golf backpack according to claim 1, wherein the fastenings comprise magnetic means.

5. The golf backpack according to claim 1, wherein the support structure is hollow and comprises holes in its outer surface for the passage of golf sticks.

6. The golf backpack according to claim 5, wherein the fastenings match with at least some of the holes in the outer surface of the support structure.

7. The golf backpack according to claim 1, wherein the support structure has a regular polygonal shape in a section of said support structure by the plane parallel to the back side of the main body.

8. The golf backpack according to claim 1, wherein the support structure has a circular shape in a section of said support structure along the plane parallel to the back side of the main body.

9. The golf backpack according to claim 1, wherein the pivot is configured to allow variation of the angle formed between the tubular boxes.

10. The golf backpack according to claim 1, wherein the support structure is fixed to the internal structure by means of a ball joint.

11. The golf backpack, according to claim 1, comprising a lumbar belt attachable to the lumbar area and waist of the user and adjustable in length.

12. The golf backpack according to claim 11, wherein the lumbar belt is detachable from the backpack.

13. The golf backpack according to claim 11, wherein the lumbar belt comprises inflation means.

14. The golf backpack, according to claim 1, comprising a chest belt attachable to the user chest area and adjustable in length.

15. The golf backpack according to claim 1, wherein at least part of the areas of said backpack in contact with the user are padded.

16. The golf backpack according to claim 1, wherein at least part of the areas of said backpack in contact with the user comprise heating means.

17. The golf backpack according to claim 1, wherein at least part of the areas of said backpack in contact with the user comprise mesh fabric configured to provide ventilation.

18. The golf backpack according to claim 1, comprising an umbrella holder arranged on outside the main body, on the front side and fixed to the internal structure.

19. The golf backpack according to claim 1, comprising a removable tripod arranged inside the main body.

20. The golf backpack according to claim 19, wherein the removable tripod comprises a plurality of legs sliding along rails until unfolded at the base of the backpack.

* * * * *